US009267388B2

(12) United States Patent
Mizokami et al.

(10) Patent No.: US 9,267,388 B2
(45) Date of Patent: Feb. 23, 2016

(54) SHROUD SEGMENT PRODUCING METHOD AND SHROUD SEGMENT

(75) Inventors: Yousuke Mizokami, Tokyo (JP); Nobuya Tao, Tokyo (JP); Takashi Tamura, Tokyo (JP)

(73) Assignee: IHI CORPORATION (JP)

( * ) Notice: Subject to any disclaimer, the term of this patent is extended or adjusted under 35 U.S.C. 154(b) by 526 days.

(21) Appl. No.: 13/807,032

(22) PCT Filed: Jul. 1, 2011

(86) PCT No.: PCT/JP2011/065159

§ 371 (c)(1), (2), (4) Date: Feb. 6, 2013

(87) PCT Pub. No.: WO2012/002528

PCT Pub. Date: Jan. 5, 2012

(65) Prior Publication Data

US 2013/0136582 A1 May 30, 2013

(30) Foreign Application Priority Data

Jul. 2, 2010 (JP) ..... P2010-152329

(51) Int. Cl.

| | |
|---|---|
| ***F01D 11/08*** | (2006.01) |
| ***F01D 9/04*** | (2006.01) |
| ***F01D 25/24*** | (2006.01) |

(52) U.S. Cl.

CPC *F01D 11/08* (2013.01); *F01D 9/04* (2013.01); *F01D 25/246* (2013.01); *F05D 2240/11* (2013.01); *F05D 2300/601* (2013.01)

(58) Field of Classification Search

CPC ..... F01D 9/04; F01D 11/08; F01D 25/246

USPC ..... 415/170.1, 173.1, 173.3; 264/255, 257, 264/320

See application file for complete search history.

(56) References Cited

U.S. PATENT DOCUMENTS

| | | | | |
|---|---|---|---|---|
| 8,297,934 | B2 * | 10/2012 | Lutz et al. | 416/230 |
| 2004/0005216 | A1 * | 1/2004 | Suzumura et al. | 415/173.3 |
| 2014/0294571 | A1 * | 10/2014 | Hillier | 415/173.4 |

FOREIGN PATENT DOCUMENTS

| | | | | | |
|---|---|---|---|---|---|
| CN | 1614199 | A | | 5/2005 | |
| CN | 101627184 | A | | 1/2010 | |
| JP | 10-103013 | | | 4/1998 | |
| JP | 10-103014 | | | 4/1998 | |
| JP | 2004-036443 | | | 2/2004 | |
| JP | 2005-153428 | | | 6/2005 | |
| JP | 2005153428 | A | * | 6/2005 | B29C 70/16 |
| JP | 2006-26993 | | | 2/2006 | |

OTHER PUBLICATIONS

International Search Report and Written Opinion mailed Aug. 2, 2011 in corresponding PCT International Application No. PCT/JP2011/065159.

(Continued)

*Primary Examiner* — Igor Kershteyn
*Assistant Examiner* — Woody A Lee, Jr.
(74) *Attorney, Agent, or Firm* — Ostrolenk Faber LLP

(57) ABSTRACT

Disclosed herein is a production method of a shroud segment that includes a forming process of molding a cylindrical fiber fabric (10) into a shroud segment shape by pressing a cylindrical surface of the fiber fabric, and a matrix forming process of impregnating the fiber fabric molded into the shroud segment shape with a matrix.

3 Claims, 3 Drawing Sheets

(56) References Cited

OTHER PUBLICATIONS

Search Report dated Dec. 4, 2013 issued in corresponding European Patent Application No. 11800990.1 (9 pages).

Chinese Office Action, dated Jun. 24, 2014, issued in corresponding to Chinese Patent Application No. 201180032589.8. English translation. Total 13 pages.

* cited by examiner

SHROUD SEGMENT PRODUCING METHOD AND SHROUD SEGMENT

CROSS-REFERENCE TO RELATED APPLICATIONS

The present application is a 35 U.S.C. §§371 national phase conversion of PCT/JP2011/065159, filed Jul. 1, 2011, which claims priority of Japanese Patent Application No. 2010-152329, filed Jul. 2, 2010, the contents of which are incorporated herein by reference. The PCT International Application was published in the Japanese language.

TECHNICAL FIELD

The present invention relates to a shroud segment producing method and a shroud segment.

BACKGROUND ART

In order to cope with a high temperature in a turbine of a gas turbine engine in recent years, it has been proposed to form a shroud installed around turbine rotor blades using a fiber-reinforced composite material such as a CMC (ceramics matrix composite).

It may be possible to obtain a lightweight shroud having high thermal resistance by forming the shroud using such a fiber-reinforced composite material.

A method is proposed in which a shroud is configured by a plurality of shroud segments divided in a circumferential direction thereof in disclosed Patent Document 1. Each of the shroud segments includes a hook portion which is locked to a support part fixed to a gas turbine casing.

When producing the shroud segment using the above-mentioned fiber-reinforced composite material, fiber fabric sheets are laminated to be molded into a shroud segment shape and a fiber fabric molded into the shroud segment shape is impregnated with a matrix.

PRIOR ART

Patent Document

[Patent Document 1]: Japanese Unexamined Patent Application, First Publication No. 2004-36443

SUMMARY OF THE INVENTION

Problems to be Solved by the Invention

Since the shroud segment of the related art made of a fiber-reinforced composite material is produced by laminating the fiber fabric sheets, fibers at side edges of the fiber fabric sheets are discontinuous in a laminated direction thereof. For this reason, there is a need to perform complicated work such as stitching to sew the fiber fabric sheets together in the laminated direction, in order to further improve the strength of the shroud. Consequently, this causes an increase in the number of production processes and the production cost.

In particular, in the shroud segment including the above-mentioned hook portion, there is a need to provide the hook portion with sufficiently high strength. Therefore, a method is required by which a shroud segment having high strength can be easily produced without performing complicated work.

The present invention has been made in view of the above-mentioned problem, and an object thereof is to be able to easily produce a shroud segment which is used in a gas turbine engine and includes a hook portion having high strength.

Means for Solving the Problems

The present invention adopts the following configurations as means to solve the above-mentioned problem.

In accordance with an aspect of the present invention, a production method of a shroud segment made of a fiber-reinforced composite material which is arranged between a casing enclosing a rotor blade and the rotor blade by locking a hook portion in a gas turbine engine, the production method of a shroud segment includes a forming process of molding a cylindrical fiber fabric into a shroud segment shape by pressing a cylindrical surface of the fiber fabric; and a matrix forming process of impregnating the fiber fabric molded into the shroud segment shape with a matrix.

When the cylindrical surface of the fiber fabric is pressed at the forming process, a gap to allow excessive deformation of the fiber fabric may be provided at the part other than a part corresponding to the hook portion.

A reinforcement member may be arranged and accommodated in the cylindrical fiber fabric and the fiber fabric may be molded, together with the reinforcement member, at the forming process.

In accordance with another aspect of the present invention, a shroud segment is made of a fiber-reinforced composite material which is arranged between a casing enclosing a rotor blade and the rotor blade by locking a hook portion in the gas turbine engine, wherein the shroud segment is made of the fiber-reinforced composite material including a plurality of continuous fibers, which has a cylindrical shape and continues without being cut in a circumferential direction thereof, and a matrix which is molded by adhesion to the continuous fibers.

Effects of the Invention

In accordance with the present invention, the cylindrical surface of the cylindrical fiber fabric is pressed to form a shroud segment shape and the matrix is formed with respect to the cylindrical fiber fabric molded into the shroud segment shape.

Therefore, it may be possible to produce the shroud segment including the continuous fibers which continue without being cut in the circumferential direction thereof, and having high strength without performing a work process such as stitching. Accordingly, according to the present invention, it may be possible to easily produce the shroud segment which is used in the gas turbine engine and includes the hook portion having high strength.

EMBODIMENTS OF THE INVENTION

Hereinafter, a shroud segment producing method and a shroud segment according to an embodiment of the present invention will be described with reference to the accompanying drawings. In the following drawings, in order to set each member to a recognizable size, scaling of each member is suitably changed.

Figure 1A:
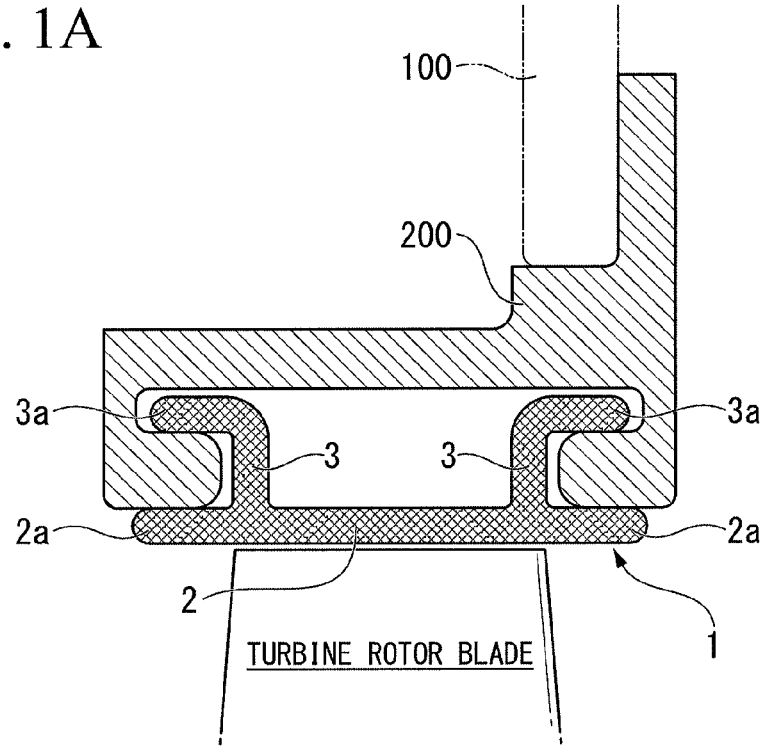
FIG. 1A is a cross-sectional view illustrating a state in which a shroud segment according to an embodiment of the present invention is installed in a turbine of a gas turbine engine.
Figure 1B:
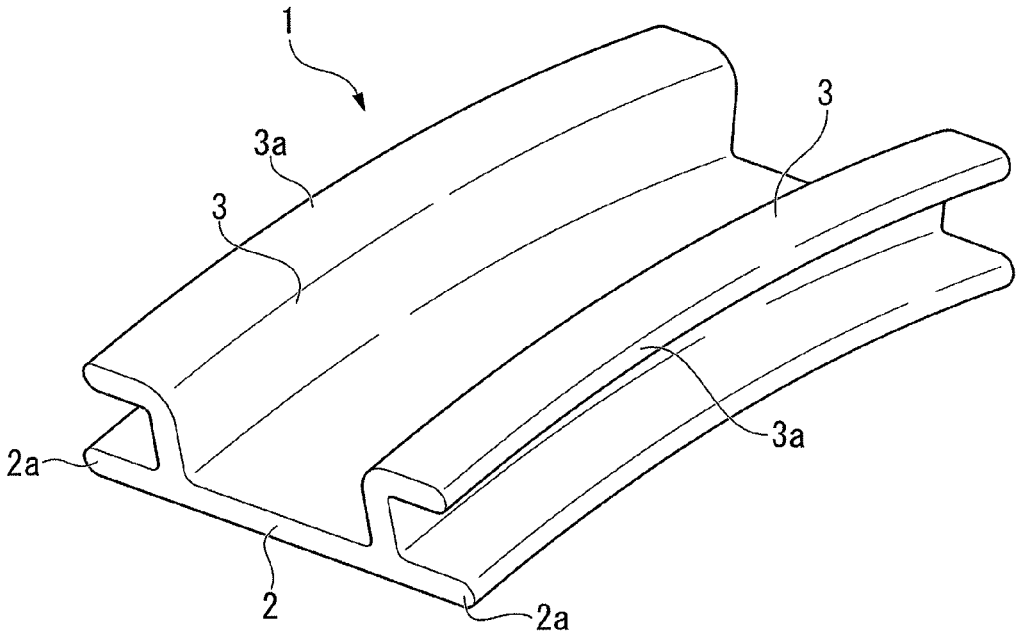
FIG. 1B is a perspective view illustrating the shroud segment according to the embodiment of the present invention.

FIGS. 1A and 1B illustrate the shroud segment according to the present embodiment. FIG. 1A is a cross-sectional view illustrating a state in which the shroud segment is installed in a turbine of a gas turbine engine, and FIG. 1B is a perspective view illustrating the shroud segment.

The shroud segment 1 in the embodiment is arranged around a turbine rotor blade and adjusts a gap around the same. A plurality of shroud segments 1 are arranged to form a ring-shaped shroud.

The shroud segment 1 in the embodiment is formed of a CMC (ceramics matrix composite). In more detail, the shroud segment 1 is formed using a fiber-reinforced composite material, as the CMC, that is composed of a fiber fabric made of silicon carbide and a matrix made of silicon carbide with which the fiber fabric is impregnated.

As shown in FIGS. 1A and 1B, the shroud segment 1 in the embodiment includes a facing portion 2 which faces a rotational region of the turbine rotor blade, and hook portions 3 which stand from the facing portion 2 and of which each tip portion 3*a* is bent in parallel with the facing portion 2.

As shown in FIGS. 1A and 1B, the facing portion 2 has a plate shape which is curved about a rotation axis of the turbine rotor blade (in a rotational direction of the turbine rotor blade).

The facing portion 2 has a length which is set to be longer than a length of the turbine rotor blade in a direction of the rotation axis. In order to secure the length of the facing portion 2 in the rotational axis direction, the facing portion 2 is provided with end portions 2*a* as protrusion portions extending further in forward and rearward directions than regions that the hook portions 3 stand.

As shown in FIG. 1A, the hook portions 3 are locked with respect to a support part 200 attached to a casing 100 of the gas turbine engine. Two hook portions 3 are provided to be spaced apart from each other in the rotational axis direction of the turbine rotor blade.

In a flow direction in the gas turbine engine, the tip portion 3*a* of the hook portion 3, which is disposed at the upstream side of the flow direction, is bent toward the upstream side. On the other hand, the tip portion 3*a* of the hook portion 3, which is disposed at the downstream side of the flow direction, is bent toward the downstream side.

In the embodiment, the shroud segment 1 has a plurality of continuous fibers which has a cylindrical shape and continues without being cut in a circumferential direction thereof, and a matrix is formed by adhesion to the continuous fibers.

The shroud segment 1 is produced by a production method which is described below.

Figure 2:
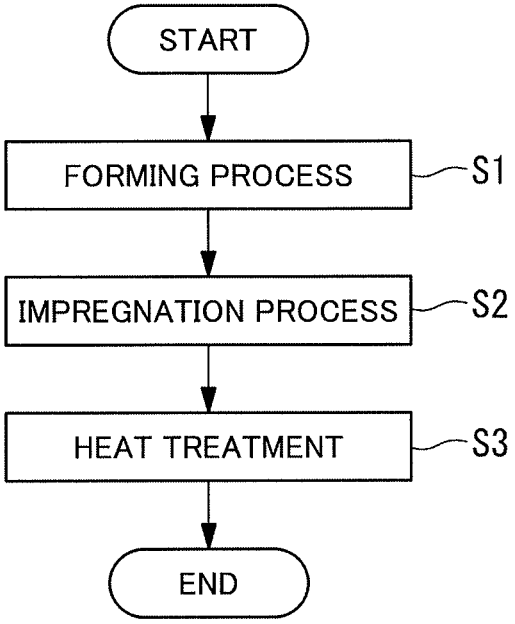
FIG. 2 is a flowchart for explaining a shroud segment producing method according to the embodiment of the present invention.

As shown in a flowchart of FIG. 2, the production method of the shroud segment 1 in the embodiment includes a forming process (S1), an impregnation process (S2), and a heat treatment (S3). A matrix forming process in the present invention is configured by the impregnation process (S2) and the heat treatment (S3).

The forming process (S1) is a process of molding the cylindrical fiber fabric into a shroud segment shape by pressing a cylindrical surface of the fiber fabric.

Figure 3A:
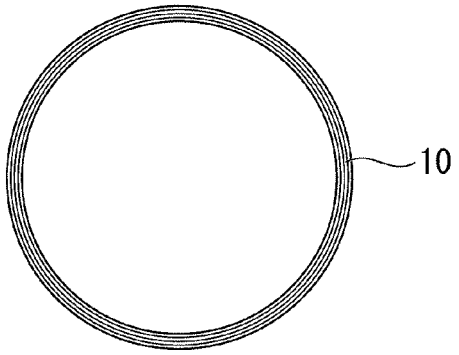
FIG. 3A is a schematic view for explaining the shroud segment producing method according to the embodiment of the present invention.

First, as shown in FIG. 3A, a cylindrical fabric 10 is used which is the cylindrical fiber fabric and set so as to have a perimeter equal to a perimeter of the shroud segment 1 and a length equal to a length of the shroud segment 1 in the rotational direction of the turbine rotor blade. The cylindrical fabric 10 is formed in such a manner that fibers made of silicon carbide are twisted to have a thread shape and the thread-shaped fibers are woven. In addition, the cylindrical fabric 10 has a predetermined thickness by overlapping a plurality of cylindrical thin fabrics having different diameters in the form of a concentric circle.

Figure 3B:
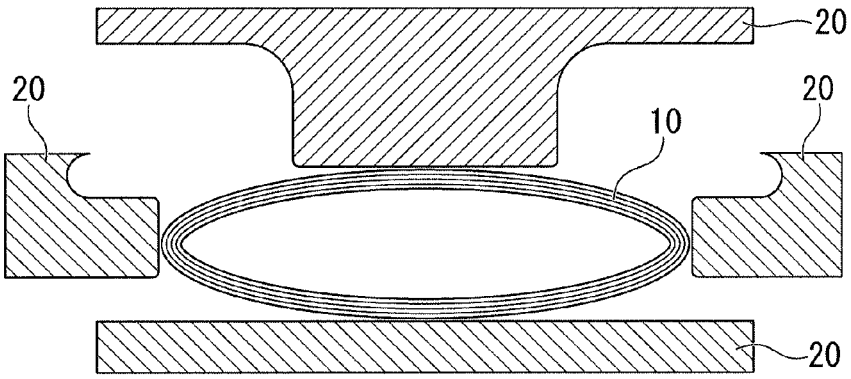
FIG. 3B is a schematic view for explaining the shroud segment producing method according to the embodiment of the present invention.
Figure 3C:
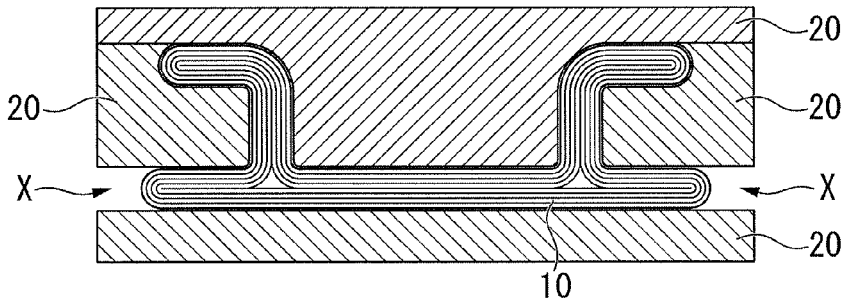
FIG. 3C is a schematic view for explaining the shroud segment producing method according to the embodiment of the present invention.

Subsequently, as shown in FIG. 3B, a plurality of molds 20 is pressed against the cylindrical surface of the cylindrical fabric 10. In addition, as shown in FIG. 3C, the molds 20 are pushed against the cylindrical fabric 10, thereby molding the cylindrical fabric 10 into a shroud segment shape. Although not shown in FIGS. 3A to 3D, each of the molds 20 has a plurality of through holes.

In addition, as shown in FIG. 3C, when being pressed by the molds 20, gaps X are provided at parts corresponding to end portions 2*a* of the facing portion 2 of the shroud segment 1.

That is, in accordance with the production method of the shroud segment 1 in the embodiment, when the cylindrical surface of the cylindrical fabric 10 is pressed at the forming process (S1), the gaps X to allow excessive deformation of the cylindrical fabric 10 are provided at the parts other than parts corresponding to the hook portions 3. The parts other than the parts corresponding to the hook portions 3 in the cylindrical fabric 10 may be flexibly deformed by the gaps X.

When the forming process (S1) is completed, the impregnation process (S2) is performed. The impregnation process (S2) is a process in which the cylindrical fabric 10 molded into the shroud segment shape is impregnated with silicon carbide. In addition, the impregnation process (S2) is executed in a state in which the cylindrical fabric 10 is pressed by the molds 20 at the forming process (S1).

The silicon carbide is impregnated using a known method such as CVI (chemical vapor impregnation) or PIP (liquid phase impregnation) as the impregnation process (S2), for example.

Subsequently, the heat treatment (S3) is performed. The heat treatment (S3) is a process of making the silicon carbide into a silicon carbide matrix by sintering the cylindrical fabric 10 after the impregnation process (S2) is completed.

The impregnation process (S2) and the heat treatment (S3) may also be repeatedly performed as necessary. The matrix may be further minutely formed by repeating the impregnation process (S2) and the heat treatment (S3).

In accordance with the production method of the shroud segment 1 in the embodiment, the cylindrical surface of the cylindrical fabric 10 is pressed to form a shroud segment shape and the matrix is formed with respect to the cylindrical fabric 10 molded into the shroud segment shape.

Therefore, it may be possible to produce the shroud segment including the continuous fibers which continue without being cut in the circumferential direction thereof, and having high strength without performing a work process such as stitching.

Accordingly, in accordance with the production method of the shroud segment 1 in the embodiment, it may be possible to easily produce the shroud segment which totally has enhanced strength by including the hook portions 3.

In the production method of the shroud segment 1 in the embodiment, when the cylindrical surface of the cylindrical fabric 10 is pressed at the forming process (S1), the gaps X to allow excessive deformation of the cylindrical fabric 10 are provided at the parts other than the parts corresponding to the hook portions 3. Therefore, the parts other than the parts corresponding to the hook portions 3 of the cylindrical fabric 10 may be flexibly deformed, and the hook portions 3 may be securely molded into a predetermined shape.

Accordingly, in the production method of the shroud segment 1 in the embodiment, it may be possible to produce the shroud segment 1 which is able to be securely locked to the support part 200.

Figure 3D:
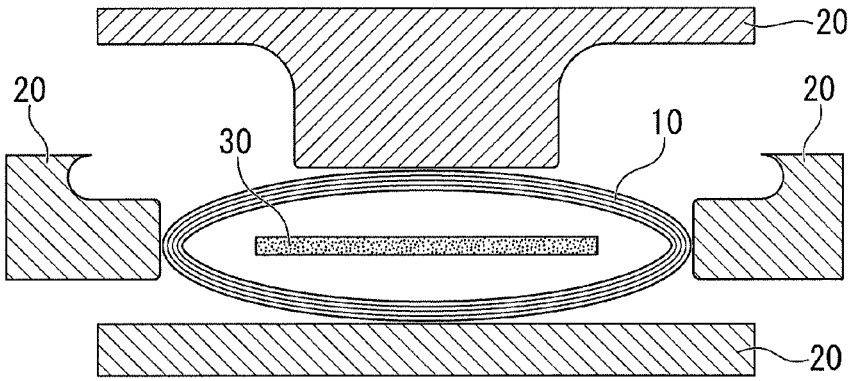
FIG. 3D is a schematic view for explaining the shroud segment producing method according to the embodiment of the present invention.

At the forming process (S1), a reinforcement member 30 is arranged and accommodated in the cylindrical fabric 10 and the cylindrical fabric 10 may also be molded together with the reinforcement member 30, as shown in FIG. 3D. Thus, it may be possible to produce the shroud segment 1 including the reinforcement member 30.

There is exemplified, for example, a ceramic plate, an auxiliary fiber fabric, or the like as the reinforcement member 30. In a case of using the ceramic plate as the reinforcement member 30, when an impact is applied to the shroud segment, the impact may be absorbed by the ceramic plate being split. As a result, it may be possible to produce the shroud segment which is strong against an impact. Also, in a case of using the auxiliary fiber fabric as the reinforcement member 30, a fiber density at a central portion of the shroud segment is enhanced, thereby enabling the shroud segment to be produced to have high strength.

Although the preferable embodiment of the present invention has been described above with reference to the accompanying drawings, the present invention is not limited thereto. Various shapes, combinations, or the like of each component illustrated in the above-mentioned embodiment serve as an example, and various modifications and variations can be made based on the design requirements and the like without departing from the spirit or scope of the present invention.

For example, it has been described that the shroud segment is formed using the fiber-reinforced composite material which is composed of the fiber fabric made of silicon carbide and the matrix made of silicon carbide with which the fiber fabric is impregnated, as an example in the above embodiment.

The present invention is not limited thereto, and the shroud segment may also be formed using other fiber subject composite material such as a fiber-reinforced composite material which is composed of a fiber fabric made of carbon and a matrix made of silicon carbide or carbon.

It has been described that the shroud segment may be produced to have high strength without performing the work process such as the stitching in the above embodiment.

The present invention does not exclude the stitching and may further additionally perform the stitching as necessary. In this case, it may be possible to produce the shroud segment having even higher strength. Furthermore, post processing may also be performed with respect to the shroud segment 1.

As shown in FIG. 3A, it has been described that the cylindrical fabric 10 is configured as an exactly circular shape when viewed in a plan view.

The present invention is not limited thereto, and the cylindrical fabric 10 may also have a shape which is not the exactly circular shape when viewed in a plan view.

INDUSTRIAL APPLICABILITY

In accordance with the present invention, it may be possible to produce a shroud segment which is used in a gas turbine engine and includes a hook portion having high strength.

REFERENCE SIGNS

1: shroud segment
2: facing portion
3: hook portion
10: cylindrical fabric
20: mold
30: reinforcement member
100: casing
200: support part

The invention claimed is:

1. A production method of a shroud segment made of a fiber-reinforced composite material which is arranged between a casing enclosing a rotor blade and the rotor blade in a gas turbine engine, the shroud segment including a facing portion and a hook portion, the facing portion facing a rotational region of the rotor blade, the hook portion standing on the facing portion and being locked with the casing, the production method of a shroud segment comprising:

a forming process of molding a cylindrical fiber fabric into a shroud segment shape by pressing a cylindrical surface of the fiber fabric; and a matrix forming process of impregnating the fiber fabric molded into the shroud segment shape with a matrix, wherein when the cylindrical surface of the fiber fabric is pressed at the forming process, a gap used to allow excessive deformation of the fiber fabric is provided so as to face an end of the facing portion other than the hook portion.

2. A production method of a shroud segment made of a fiber-reinforced composite material which is arranged between a casing enclosing a rotor blade and the rotor blade in a gas turbine engine, the production method of a shroud segment comprising:

a forming process of molding a cylindrical fiber fabric into a shroud segment shape by pressing a cylindrical surface of the fiber fabric; and a matrix forming process of impregnating the fiber fabric molded into the shroud segment shape with a matrix, wherein a reinforcement member is arranged and accommodated in the cylindrical fiber fabric and the fiber fabric is molded, together with the reinforcement member, at the forming process.

3. A shroud segment arranged between a casing enclosing a rotor blade and the rotor blade in a gas turbine engine, the shroud segment comprising:

a) a fiber-reinforced composite material molded into a shape to engage with said casing, comprising:

a plurality of continuous fibers which continue without being cut in an extending direction thereof; and a matrix which is molded by adhesion to the continuous fibers b) wherein said shroud segment further comprises a reinforcement member molded inside the plurality of continuous fibers.

* * * * *